United States Patent [19]

Halverson

[11] Patent Number: 4,653,404

[45] **Date of Patent: * Mar. 31, 1987**

[54] HIGH VELOCITY NOTCHED AMMUNITION SABOT

[75] Inventor: Henry J. Halverson, Collinsville, Ill.

[73] Assignee: Olin Corporation, Stamford, Conn.

[ * ] Notice: The portion of the term of this patent subsequent to Mar. 11, 2003 has been disclaimed.

[21] Appl. No.: 794,882

[22] Filed: Nov. 4, 1985

Related U.S. Application Data

[63] Continuation-in-part of Ser. No. 585,327, Mar. 1, 1984, Pat. No. 4,574,703, and Ser. No. 705,957, Feb. 27, 1985.

[51] Int. Cl.[4] ..... F42B 13/16

[52] U.S. Cl. ..... 102/520; 102/522

[58] Field of Search ..... 102/520–522

[56] References Cited

U.S. PATENT DOCUMENTS

| | | | |
|---|---|---|---|
| 3,164,092 | 1/1965 | Reed | 102/522 |
| 3,435,768 | 4/1969 | Engel | 102/523 |
| 3,771,458 | 11/1973 | Schweimler et al. | 102/523 |
| 4,148,259 | 4/1979 | Yuhash et al. | 102/522 |
| 4,488,491 | 12/1984 | Rhodes | 102/522 |
| 4,574,703 | 3/1986 | Halverson | 102/520 |

*Primary Examiner*—Harold J. Tudor

*Attorney, Agent, or Firm*—Bruce E. Burdick

[57] ABSTRACT

A high velocity ammunition sabot with internal notches of special design to give reliable break-up upon exit from a rifled gun barrel due to centrifugal forces.

5 Claims, 3 Drawing Figures

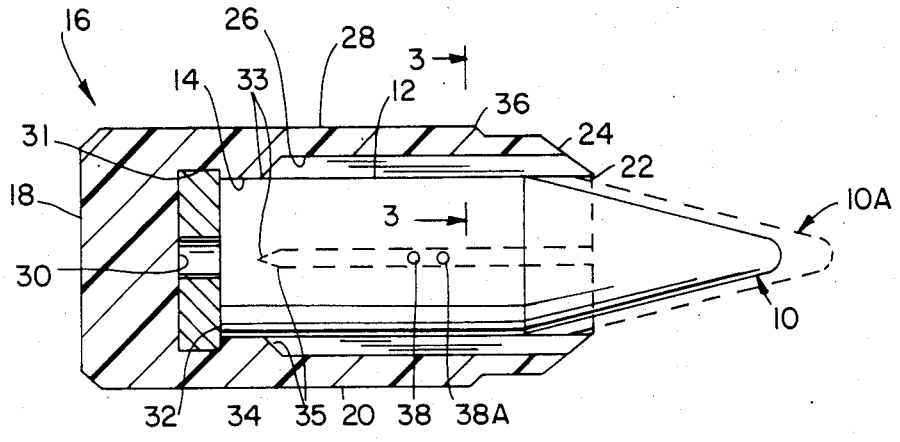
FIG. 1
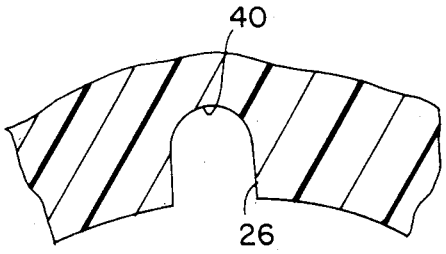
FIG. 3
FIG. 2
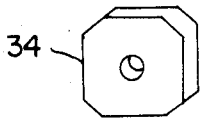

HIGH VELOCITY NOTCHED AMMUNITION SABOT

BACKGROUND AND SUMMARY OF THE INVENTION

This application is a continuation-in-part of co-pending U.S. patent applications Ser. Nos. 06/585,327, filed Mar. 1, 1984, now U.S. Pat. No. 4,574,703, and 06/705,957, filed Feb. 27, 1985, the disclosure of which are incorporated by reference as if set forth at length herein.

This invention relates to ammunition sabots and particularly to a disintegrating sabot.

"Small caliber" as used herein means 0.50" caliber and below. The state of the art in plastic small caliber sabots has basically remained static since the development of the plastic sabot for hunting ammunition shown in U.S. Pat. No. 3,164,092, issued Jan. 5, 1965, to D. S. Reed et al and assigned to Remington Arms Company, Inc. and which relates to the well-known Remington "Accelerator" hunting cartridge which uses a lead bullet in a cup-shaped polycarbonate sabot, the sabot having slots to form petals which peel back due to centrifugal force to increase air resistance of the sabot and thereby cause separation of the sabot from the bullet.

There is a constant desire to increase the speed, hardness, and density of lightweight subcaliber rifle bullets so that they will penetrate harder and thicker targets, especially military armor. However, it has not been known how to do this in conventional rifles due to the denser bullet materials that are required and the inability of existing sabots, such as that taught by the Reed et al patent above, to withstand the forces imposed by such launches of subcaliber projectiles having higher sectional density and hardness than the soft lead hunting bullets taught by the Reed et al patent.

The present invention provides a solution to this problem by providing a cup-shaped ammunition sabot which has internal notches extending axially from the front of the sabot to a location forward of the base, the notch having a pointed end at the location, the point of the pointed end being directed axially toward the base so as to concentrate the impact-like centrifugal forces and stresses at said notch. The notch strength of the sabot material is sufficiently low that the sabot petals immediately separate by fracture from the base upon exit from a rifle barrel. Thus, the sabot immediately breaks apart so that the sabot petals and base do not interfere with the flight of the projectile or make the projectile inaccurate.

BRIEF DESCRIPTION OF THE DRAWINGS

The invention will be better understood by reference to the attached drawing in which:

FIG. 1 is a cross-sectional view taken along the axis of a preferred sabot and projectile of the invention, and FIG. 2 is cross-sectional view similar to that of FIG. 1, but showing a sabot modified to accept a traced projectile, and FIG. 3 is a cross-sectional view taken along lines 3—3 of FIG. 1, but not showing the projectile.

DETAILED DESCRIPTION OF THE PREFERRED EMBODIMENTS

A projectile 10 is shown having a major cylindrical rear portion 12 carried with a central recess 14 of a generally cylindrical monolithic plastic sabot 16 which has a cylindrical rear base portion 18 and a tubular front wall portion 20. Front portion 20 comprises a plurality of arcuate cylindrical segments or "petals" 22 connected by weakened portions 24 extending axially on portion 20. Weakened portions 24 are weakened by spaced axial grooves or notches 26 on the inner periphery of central recess 14. Notches 26 run axially from the front end of sabot 16 part way back on the inner periphery of front portion 20 to a location forward of base 18. The outer periphery 28 of sabot 16 is an uninterrupted cylindrical surface. In addition to notches 26, it is desirable to further define the location at which petals 22 break off from base portion 18 by having a circumferential groove 31 at the junction of the wall 20 with base 18. The dimensions of the notch are selected to reduce tensile strength of plastic at outer perimeter of notch so that centrifugal force upon exiting the barrel will be greater than plastic strength and cause fracture and yet not reduce strength so that fracture occurs inbore due to torque applied by rifling. Parameters are (a) plastic's mechanical properties, (b) projectile velocity and (c) rifling angle (twist rate).

Between the floor 20 of recess 14 of sabot 16 and the rear end 32 of projectile 10 is preferably a metallic square washer with rounded corners 34 (also shown in FIG. 2) which extends radially inward and outward of the inner periphery of central recess 14 so as to distribute the accelerational forces during explosive discharge of sabot 16 and projectile 10 together through a rifled gun barrel (now shown) and to prevent rotational slippage between sabot 16 and washer 34 during spin-up of sabot 16 during such discharge. Washer 34 could be of other polygonal symmetrical shapes such as pentagonal, hexagonal or gear-shaped. Washer 34 preferably has rounded corners to reduce stress concentrations at its corners and to allow use of bigger area washers.

Outer periphery of 28 of sabot 16 is of a substantially constant diameter equal or slightly larger than barrel groove diameter from base 18 up to an axial point 36 which is located forward of the center of gravity 38 of projectile 10 to minimize balloting of projectile 10 during its passage through a rifled gun barrel, as might occur if point 36 was located back of center of gravity 38. In addition, this constant diameter portion is a continuous surface (i.e. without external notches or grooves) so as to maximize obturation in order to maximize projectile velocity and to prevent contamination (e.g. dirt) which could prematurely break petals within bore upon firing. A second optional heavy projectile **10*a* is also shown having a center of gravity 38*a*, which is also behind point 36**.

Sabot 16 is of 7.62 mm caliber and carries a 52 grain tungsten projectile 10 or a 57 grain tungsten projectile **10*a*. Other calibers of sabot 16 such as 5.56 mm or 0.50 caliber could also be utilized and other sizes, materials, and shapes of projectiles 10** could be utilized, if desired.

The plastic for sabot 10 is preferably of a material that has sufficient tensile strength (at least 12,000 psi when tested under the standard ASTM Test Method D1708), compressive strength (at least 15,000 psi when tested under the standard ASTM Test Method D695), and sufficient shear strength (at least 12,000 psi when tested under the standard ASTM Test Method D732) to withstand the shock of explosive discharge from a rifled gun barrel while carrying projectile 10 but having insufficient (less than about 12 ft-lbs./in.) Izod impact strength when tested under the standard ASTM Test Method D256 to withstand centrifugal and aerodynamic forces following discharge so that sabot 16 disintegrates immediately (i.e., within a yard) after exiting the barrel muzzle, thus immediately freeing the projectile 10 for unimpeded flight to the target.

One suitable plastic material is "ULTEM 1000", an unreinforced amorphous polyetherimide thermoplastic resin marketed by General Electric Company. Some other plastics believed to be suitable are ULTEM 2200, a 20% glass reinforced polyetherimide resin the LEXAN 3412, a 20% glass reinforced polycarbonate resin, both from General Electric Company and TORLON 423L engineering resin from Amoco Chemicals Corporation. Other plastics with equivalent mechanical properties could be utilized if the mechanical properties of the plastic are not chemically deteriorated by any exposure to propellants with which it is expected to be utilized.

The notches must be pointed at their rear end location 33 and the point 35 should be aimed axially at the base of the sabot but yet separated by an axial distance from the base of the sabot. The separation distance is desired to give the front portion or wall of the sabot sufficient strength so that the petals do not fracture in the barrel due to the large torque applied to the sabot petals when the petals engage the rifling. If the internal grooves extend all the way to the base; it was found that the sabot breaks apart in the barrel, presumably due to premature fracture of the petals. Since the projectile 10 or 10*a* is preferably harder than the barrel and intended to penetrate armour plate, the projectile is likely to damage or render inoperable the barrel if the sabot breaks apart in the barrel. The grooves should not be external nor extend clear through the wall in that portion of the wall which contacts the rifling (as is the case with the Remington "Accelerator" sabot). If they do, poor accuracy results. This is theorized to be caused by the petals bunching up in the barrel in response to the torque during spin-up, thus distorting the sabot and causing balloting of the projectile.

Referring to FIG. 3, the shape of notches 26 in the direction transverse to the axis of the projectile is also important. It has been found that a rounded outer end wall 40 of the notch is desirable to produce reliable fracturing and to minimize stress concentrations which might lead to premature cracking of the sabot during prolonged storage and rapid changes in temperature (thermal shock).

It is not necessary for this invention that there be a washer 34 or other metallic area multiplier, although one may be desirable or necessary where the projectile core is very dense or sharp and might otherwise punch through the base or fail to conform to the sabot cavity through deformation sufficiently to give the frictional hold between the sabot and core during loading, chambering or launch which is necessary for adequate spin-up of the core.

It is preferable that an internal circumferential groove be provided at the junction of the front portion and base of the sabot. Where there is a washer 34, this will normally be provided in order to hold washer 34 in position. Such a groove helps define uniformly the location at which petals separate from the base.

While one preferred embodiment is shown, it will be apparent that minor changes could be made within the scope of the invention as defined by the claims below. For example, while the base is shown solid, it could be modified by having one or more passageways therethrough to allow the propellant flame to reach a traced projectile, as seen in my parent application Ser. No. 06/705,957 (referenced above), filed Feb. 27, 1985.

What is claimed is:

1. A unitary plastic sabot for projection of a metallic subcaliber projectile through a rifled gun barrel, said sabot comprising:

a cylindrical rear base portion;

a cylindrical front portion with a continuous cylindrical outer surface and a cylindrical central recess defining an annular wall adapted to surround and receive a major rear portion of the projectile;

the wall having a plurality of arcuate cylindrical segments connected by weakened portions extending axially on the wall, the weakened portions being defined by rearwardly pointed spaced axial outwardly rounded grooves on the inside of the wall and a continuous cylindrical outer portion of the wall;

said sabot being of a plastic material having compressive strength of at least 15,000 psi as measured by ASTM Test Method D695 and shear strength of at least 12,000 psi as measured by ASTM Test Method D732 to withstand the compressive and shear forces of explosive discharge through said barrel while carrying the projectile in said recess and having an impact notch strength of less than 12 ft-lbs/inch as measured by ASTM Test Method D256 in the portion of the wall between the rear pointed ends of the grooves and the base of the sabot to withstand the sudden application of aerodynamic and centrifugal forces to the wall following the discharge so that after the discharge the wall immediately and substantially simultaneously splits at each groove and the wall segments separate from the base to thereby free the projectile for further flight and whereby the weakened portion of the projection can prior to discharge assist in obturation of the barrel.

2. The sabot of claim 1, further comprising an internal circumferential annular groove in the wall at the junction of the wall with the base, whereby the wall is encouraged to separate at the groove location from the base.

3. The sabot of claim 1 wherein said base portion includes a metallic disc forming a base for the recess whereby to help prevent destruction of the sabot during launch.

4. The sabot of claim 3 wherein said disc is a square washer with rounded corners.

5. The sabot of claim 3 wherein said disc is of greater outside diameter than the diameter of the recess defined by the wall whereby the disc serves as to increase the area of the base portion upon which inertial forces of launching a heavy projectile act.

* * * * *